US012788135B2

(12) United States Patent
Thornton et al.

(10) Patent No.: US 12,788,135 B2
(45) Date of Patent: Nov. 10, 2026

(54) BRUSHBAR FOR A VACUUM CLEANER

(71) Applicant: Dyson Technology Limited, Wiltshire (GB)

(72) Inventors: Frederick Michael Thornton, Malmesbury (GB); Nichola Lauren Clifton, Swindon (GB); Robert Michael Cox, Warwick (GB); Oliver Francis Burke, Eindhoven (NL); Thomas Michael Mcvey, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 394 days.

(21) Appl. No.: 18/287,984

(22) PCT Filed: Apr. 22, 2022

(86) PCT No.: PCT/GB2022/051023
§ 371 (c)(1),
(2) Date: Oct. 23, 2023

(87) PCT Pub. No.: WO2022/229607
PCT Pub. Date: Nov. 3, 2022

(65) Prior Publication Data

US 2024/0197068 A1 Jun. 20, 2024

(30) Foreign Application Priority Data

Apr. 26, 2021 (GB) ..... 2105937

(51) Int. Cl.
*A46B 13/00* (2006.01)
*A46B 9/02* (2006.01)
(Continued)

(52) U.S. Cl.
CPC ..... *A46B 13/006* (2013.01); *A46B 9/025* (2013.01); *A46B 9/026* (2013.01); *A46B 13/02* (2013.01);
(Continued)

(58) Field of Classification Search
CPC ..... A46B 13/006; A46B 13/02; A46B 9/025; A46B 9/026; A46B 2200/3033;
(Continued)

(56) References Cited

U.S. PATENT DOCUMENTS 2,411,488 A * 11/1946 White ..... A47L 9/0477 29/451
2,659,921 A 11/1953 Osborn
(Continued)

FOREIGN PATENT DOCUMENTS

CN 102631170 A * 8/2012 ..... A47L 9/04
CN 107997678 A 5/2018
(Continued)

OTHER PUBLICATIONS

Mark CN102631170 Espacenet—English Machine Translation (Year: 2012).*
(Continued)

*Primary Examiner* — Nathaniel E Wiehe
*Assistant Examiner* — Wayne A Lambert
(74) *Attorney, Agent, or Firm* — Tucker Ellis LLP; Michael G. Craig

(57) ABSTRACT

A brushbar for a vacuum cleaner is described. The brushbar includes a cylindrical body, one or more pairs of bristle strips and one or more plush strips arranged helically about the body. Each pair of bristle strips includes a first strip of first bristles and a second strip of second bristles, the first bristles being stiffer and shorter than the second bristles. The
(Continued)

plush strips are arranged on either side of each pair of bristle strips and include a plush of fibres.

21 Claims, 3 Drawing Sheets

(51) Int. Cl.
*A46B 13/02* (2006.01)
*A46D 1/00* (2006.01)
*A47L 9/04* (2006.01)

(52) U.S. Cl.
CPC ..... *A46D 1/0207* (2013.01); *A47L 9/0405* (2013.01); *A47L 9/0477* (2013.01); *A46B 2200/3033* (2013.01)

(58) Field of Classification Search
CPC ... A46D 1/0207; A47L 9/0405; A47L 9/0477; A47L 11/18; A47L 11/302; A47L 11/4041; A47L 11/19
See application file for complete search history.

(56) References Cited

U.S. PATENT DOCUMENTS 4,177,536 A * 12/1979 Powers ..... A47L 5/30 15/366
4,209,873 A * 7/1980 Schaefer ..... A47L 9/0477 15/366
4,372,004 A * 2/1983 Vermillion ..... A47L 5/30 15/195
4,426,751 A * 1/1984 Nordeen ..... A47L 9/0433 15/384
4,912,805 A * 4/1990 Krasznai ..... A47L 9/0477 15/207.2
5,452,490 A * 9/1995 Brundula ..... A47L 9/0477 15/207.2
5,495,634 A * 3/1996 Brundula ..... A47L 9/0477 15/179
6,760,952 B1 * 7/2004 Stegens ..... A47L 9/0477 15/366
8,256,059 B2 * 9/2012 Morphey ..... A46B 13/02 15/179
9,320,398 B2 * 4/2016 Hussey ..... A47L 11/4011
9,326,654 B2 5/2016 Doughty
9,693,663 B2 * 7/2017 Kasper ..... A46B 3/16
10,092,153 B2 10/2018 Shim et al.
2005/0039282 A1 * 2/2005 Paterson ..... A47L 9/0477 15/179
2006/0076035 A1 * 4/2006 McGee ..... A47L 11/4069 15/52.1
2006/0272122 A1 * 12/2006 Butler ..... A47L 9/0455 15/383
2009/0229075 A1 * 9/2009 Eriksson ..... A46B 13/006 15/48
2010/0306957 A1 * 12/2010 Follows ..... A46B 13/02 15/363
2011/0146009 A1 * 6/2011 Marsh ..... A46D 3/04 15/21.1
2015/0342430 A1 * 12/2015 Kasper ..... A46B 13/006 15/183
2017/0347848 A1 12/2017 Carter et al.
2018/0296046 A1 10/2018 Thorne et al.
2018/0338654 A1 11/2018 Kelsey
2019/0298123 A1 10/2019 Conrad et al.
2020/0107684 A1 4/2020 Williams et al.
2020/0305672 A1 10/2020 Johnson et al.
2021/0212535 A1 * 7/2021 Kegg ..... A46B 7/10

FOREIGN PATENT DOCUMENTS

CN 110623415 A 12/2019
EP 2440099 A1 4/2012
EP 2833775 A1 2/2015
GB 1023556 A 3/1966
JP 55-067777 A 5/1980
JP 05-192271 A 8/1993
JP 11318781 A * 11/1999
JP 2007-007501 A 1/2007
JP 5279066 B2 9/2013
JP 5300124 B2 9/2013
JP 2017-189269 A 10/2017
JP 2017-211621 A 11/2017
KR 20170090708 A * 8/2017 ..... A47L 9/0488
WO 2010/142970 A1 12/2010
WO 2014/151501 A1 9/2014
WO 2021/064355 A1 4/2021
WO 2022/229607 A1 11/2022

OTHER PUBLICATIONS

Examination Report received for GB Application No. 2105937.3, mailed on Jul. 6, 2023, 2 pages.
International Search Report and Written Opinion received for PCT Patent Application No. PCT/GB2022/051023, mailed on Aug. 3, 2022, 10 pages.
Search Report received for GB Application No. 2105937.3, mailed on Oct. 5, 2021, 2 pages.

* cited by examiner

BRUSHBAR FOR A VACUUM CLEANER

CROSS-REFERENCE TO PRIOR APPLICATION

This application is a § 371 National Stage Application of PCT International Application No. PCT/GB2022/051023 filed Apr. 22, 2022, which claims the priority of United Kingdom Application No. 2105937.3, filed Apr. 26, 2021, each of which are herein incorporated by reference in their entirety.

FIELD OF THE INVENTION

The present invention relates to a brushbar for a vacuum cleaner, and to a cleaner head comprising the brushbar.

BACKGROUND OF THE INVENTION

A vacuum cleaner may comprise a brushbar, which rotates to agitate and lift dirt from a surface. Some vacuum cleaners may comprise interchangeable heads having different brushbars for use on different surface types. For example, a vacuum cleaner may comprise a first cleaner head having a brushbar with stiff bristles for use on carpets, and a second cleaner head having a brushbar with flexible bristles for use on hard floors.

SUMMARY OF THE INVENTION

The present invention provides a brushbar for a vacuum cleaner comprising: a cylindrical body; one or more pairs of bristle strips arranged helically about the body, each pair of bristle strips comprising a first strip of first bristles and a second strip of second bristles, the first bristles being stiffer and shorter than the second bristles; and one or more plush strips arranged helically about the body, the plush strips being arranged on either side of each pair of bristle strips and comprising a plush of fibres.

The first bristles, being shorter and stiffer, may be used to agitate dirt from carpeted surfaces, whereas the second bristles, being longer and more flexible, may be used to sweep dirt from hard surfaces, such as wooden or tiled surfaces. The fibres, being formed as a plush, may compromise the pickup performance of the brushbar, particularly on carpeted surfaces. However, by providing plush strips, the pressure within the head of the vacuum cleaner may be improved, which may improve dirt pickup. This is particularly true when the vacuum cleaner comprises front slots or openings through which large debris may be picked up. Such slots normally compromise the pressure within the head of the vacuum cleaner, resulting in a drop in pickup performance. However, as the brushbar rotates, the plush strips create a restriction between the brushbar and the surrounding housing which reduces the flow of air over the top of the brushbar, thereby maintaining a good pressure within the cleaner head. In addition to improving head pressure, the plush strips may also provide a buffing or polishing effect when the brushbar is used on hard surfaces.

With the brushbar of the present invention, the bristles strips are grouped into pairs. The plush strips are then arranged on either side of each pair of bristle strips. Conceivably, the bristle strips, rather than being grouped into pairs, could be arranged evenly about the body, and plush strips may be provided between each pair of bristle strips. However, by grouping the bristle strips into pairs, the number of plush strips may be halved, thereby simplifying the manufacture and assembly of the brushbar. Additionally, the total surface area of the plush strips may be increased, which in turn provides a greater restriction and thus improved head pressure during use.

The second strip is intended to trail the first strip during rotation of the brushbar. By providing the bristle strips in pairs, the first bristles, being stiffer, may act to protect the second bristles from the impact of large debris, which might otherwise damage the second bristles. There may also be acoustic benefits in grouping the bristle strips into pairs. For example, if the brushbar were to comprise four bristle strips spaced evenly about the body, the bristle strips would impact the cleaning surface four times with each rotation of the brushbar. By grouping the bristles strips into pairs, each pair of bristle strips may be regarded as generating a single impact. Accordingly, in this example, the bristle strips impact the cleaning surface twice with each rotation. By halving the number of impacts with each rotation, the level of noise may be reduced and/or the quality of the noise may be improved.

The first and second bristles may be formed of different materials. This then has the advantage that different materials having different characteristics may be targeted at different surface types. For example, bristles of a first material may be used to agitate dirt on carpeted surfaces, and bristles of a second material may be used to agitate dirt on hard surfaces. The first bristles may be formed of a plastic material, and the second bristles may be formed of carbon fibre or a carbon composite material. The first bristles, being formed of a plastic material, are relatively robust and non-brittle and are therefore well-suited to agitating carpeted surfaces. The second bristles, bring formed of a carbon fibre or carbon composite material, are less likely to charge hard surfaces with static electricity. As a result, dirt may be more easily lifted from the hard surfaces.

The second strip may comprise third bristles in addition to the second bristles. Moreover, the third bristles may be located adjacent to the second bristles, and the third bristles may be stiffer than the second bristles. The third bristles are then able to support the second bristles. This then has the advantage that relatively long and fine bristles may be used for the second bristles to provide a gentle sweeping action across hard surfaces. Without the support provided by the third bristles, the direction and movement of the second bristles may be less well controlled, resulting in poor dirt pickup. The third bristles may abut against the second bristles. The third bristles may be located behind the second bristles relative to a direction of rotation of the brushbar when in use. The second bristles may be formed of carbon fibre or a carbon composite material, and the third bristles may be formed of a plastic material.

The bristles of the second strip may be canted in a direction away from the first strip. Canting should be understood to mean that, in a plane normal to the central longitudinal axis of the brushbar, the bristles are angled relative to a radial line passing through the base of the bristles. Canting the bristles of the second strip has at least two potential advantages. First, longer bristles having the same radial extent may be used. By employing longer bristles, the required flexibility in the bristles may be achieved using thicker bristles, thereby improving the robustness and reliability of the bristles. Second, by canting the bristles rearward, the bristles perform a sweeping action on contact with the cleaning surface. The load on the brushbar is therefore reduced, and thus the power drawn by the brushbar (i.e. the electrical power required to drive the brushbar at a given torque and/or speed) is reduced.

The bristles of the second strip may be canted at an angle of between 40 and 60 degrees. That is to say that, in a plane normal to the central longitudinal axis of the brushbar, the bristles may be canted at an angle of between 40 and 60 degrees relative to a radial line passing through the base of the bristles. This range in the cant angle has been found to provide a relatively good balance between pickup performance and power draw.

Each pair of bristle strips may subtend a first central angle in a plane normal to a central longitudinal axis of the brushbar, and each plush strip may subtend a second central angle. The second central angle may then be greater than the first central angle. As a result, the majority of the body of the brushbar may be covered with plush fibres, which in turn provides a greater restriction and improved head pressure. Where the bristles of the second strip are canted, the central angle is measured at the base of the bristles.

The fibres may have a lower stiffness than the first bristles, and a shorter length than the second bristles. The fibres are therefore able to provide a restriction within the cleaner head of the vacuum cleaner without necessarily drawing excessive power when coming into contact with the cleaning surface. Moreover, by employing fibres that are shorter than the second bristles, the fibres may be spaced from the cleaning surface when using the brushbar on hard surfaces.

The brushbar may comprises a first circumferential spacing between the bristles of the first strip and the fibres of the adjacent plush strip, and the first circumferential spacing may be no smaller than the length of the fibres. This then has the advantage that, when the fibres flex or deform rearwards on contacting the cleaning surface, the fibres do not interfere with or get caught up in the bristles of the first strip. Additionally or alternatively, the brushbar may comprise a second circumferential spacing between the bristles of the second strip and the fibres of the adjacent plush strip, and the second circumferential spacing may be no smaller than the length of the second bristles. Again, this then has the advantage that, when the second bristles flex or deform rearwards on contacting the cleaning surface, the second bristles do not interfere with or get caught up in the fibres of the plush strip.

Each of the bristle strips may comprises castellations (i.e. notches) in the bristles. Moreover, the castellations in the bristles of the first strip and the castellations in the bristles of the second strip may be aligned in planes normal to a central longitudinal axis of the brushbar. The cleaner head of the vacuum cleaner may comprise one or more bars that extend across the suction opening of the cleaner head. The bars may act to prevent rugs, carpet or the like being lifted up into the cleaner head. By providing castellations in the bristle strips, the castellations may be aligned with the bars in the cleaner head. As a result, the power drawn by the brushbar may be reduced, and/or the noise generated by the brushbar may be reduced or the quality improved.

The brushbar may comprises two pairs of bristle strips. The bristle strips therefore contact the cleaning surface twice during each rotation of the brushbar. Consequently, in comparison to a single pair of bristle strips which contacts the cleaning surface only once, the same degree of agitation may be achieved (i.e. the same power may be driven into the cleaning surface) using less dense or more flexible bristles. This in turn may reduce the noise generated by the brushbar. However, by employing two pairs of bristles, the available area of the body that may be covered by the plush of fibres is reduced and thus the pressure with the cleaner head may be compromised, in comparison to a single pair of bristle strips. However, this potential loss in head pressure may be recovered by increasing the speed of the brushbar.

Each of the bristle strips may span 360 degrees about the body. As a result, each bristle strip may be in constant contact with the cleaning surface. This may then have benefits in terms of noise and power draw during rotation of the brushbar. By contrast, if the bristle strips spanned a smaller angle then the level and/or quality of the noise may worsen and/or the power drawn by the brushbar may vary as different bristle strips come into contact and then leave the cleaning surface.

The present invention also provides a cleaner head for a vacuum cleaner comprising: a housing having a suction chamber; a brushbar as described in any one of the preceding paragraphs, the brushbar being rotatably mounted within the suction chamber; and a suction opening formed on an underside of the housing through which the brushbar is able to agitate a surface.

The cleaner head may comprise one or more debris slots formed in a front of the housing through which debris may pass to the suction chamber. With a conventional brushbar, the debris slots would compromise the pressure within the suction chamber, resulting in a drop in pickup performance. By contrast, the brushbar comprises plush strips that create a restriction between the brushbar and the housing which reduces the flow of air over the top of the brushbar, thereby maintaining a good pressure within the suction chamber.

The cleaner head may comprise one or more bars that extend across the suction opening, the bristle strips may project downward beyond the bars, and the bristle strips may comprise castellations in the bristles that are aligned with the bars. The bars may act to prevent rugs, carpet, or the like being lifted up into the suction chamber. If the bristle strips were continuous, the bristles would beat against the bars as the brushbar rotates, consuming power and generating noise. By providing castellations (i.e. notches) in the bristle strips that are aligned with the bars, the power drawn by the brushbar may be reduced and/or the level of noise generated by the brushbar may be reduced and/or the quality improved.

The second strip may trail the first strip in a direction of rotation of the brushbar. The first bristles, being stiffer, may then act to protect the second bristles from the impact of large debris, which might otherwise damage the second bristles. Additionally and/or alternatively, by having the longer, more flexible second bristles trail the first bristles, the two bristle strips may be brought closer together whilst ensuring that the leading bristles, when flexing rearwardly on contacting the cleaning surface, do not interfere with or get caught up in the trailing bristles. By minimising the space between the bristles strips in each pair, larger plush strips may be employed, which in turn provides a greater restriction and thus improved head pressure.

The cleaner head may comprise a drive assembly for driving the brushbar, the brushbar may comprise two pairs of bristle strips, and the drive assembly may drive the brushbar at an unloaded speed of between 2500 rpm and 3500 rpm. As noted above, by employing two pairs of bristle strips, the same degree of agitation as that of a single pair of bristles strips may be achieved using less dense or more flexible bristles. This in turn may reduce the noise generated by the brushbar. However, by employing two pairs of bristles, the available area of the body that may be covered by plush fibres is reduced and thus the pressure with the suction chamber may be compromised, in comparison to a single pair of bristle strips. This potential loss in pressure may be recovered by increasing the speed of the brushbar.

Moreover, a good balance between pickup performance and noise may be observed at speeds of between 2500 rpm and 3500 rpm.

The present invention further provides a brushbar for a vacuum cleaner comprising one or more bristle strips arranged helically about a body, wherein each bristle strip comprises a strip of castellated bristles.

The cleaner head of the vacuum cleaner may comprise one or more bars that extend across the suction opening of the cleaner head. By providing castellations in the bristle strips, the castellations may be aligned with the bars in the cleaner head. As a result, the power drawn by the brushbar may be reduced, and/or the noise generated by the brushbar may be reduced or the quality improved.

The present invention additionally provides a cleaner head for a vacuum cleaner comprising a housing having a suction chamber, a brushbar rotatably mounted within the suction chamber, a suction opening formed in an underside of the housing, and one or more bars that extend across the suction opening, wherein the brushbar comprises one or more bristle strips arranged helically about a body, the bristle strips project downward beyond the bars, and the bristle strips comprise castellations in the bristles that are aligned with the bars.

The present invention also provides a vacuum cleaner comprising a brushbar or a cleaner head as described in any one of the above paragraphs.

The vacuum cleaner may be an autonomous vacuum cleaner. With a manual vacuum cleaner, such as an upright, canister or stick vacuum cleaner, the cleaner head of the vacuum cleaner may be interchanged relatively easily by a user. With an autonomous vacuum cleaner, on the other hand, the vacuum cleaner may be required to clean different surface types without user intervention. With the brushbar described above, relatively good pickup performance may be achieved across different surface types, including carpets and hard floors. The brushbar is therefore ideally suited for use in an autonomous vacuum cleaner. The cleaner head of a manual vacuum cleaner may include an actuator, such as a switch or slider, to selectively open and close slots for picking up large debris. Such slots normally compromise the pressure within the cleaner head, resulting in an overall drop in pickup performance. However, a user may open the slots momentarily upon identifying large debris, and close the slots shortly thereafter once the large debris has been picked up. With an autonomous vacuum cleaner, such control is not straightforward. With the brushbar described above, the plush strips create a restriction between the brushbar and the surrounding housing. As a result, the vacuum cleaner may comprise debris slots that are permanently open, whilst the restriction provided by the plush strips ensures that a good pressure is maintained within the cleaner head.

BRIEF DESCRIPTION OF THE DRAWINGS

Embodiments will now be described, by way of example, with reference to the accompanying drawings in which.

DETAILED DESCRIPTION OF THE INVENTION

Figure 1:
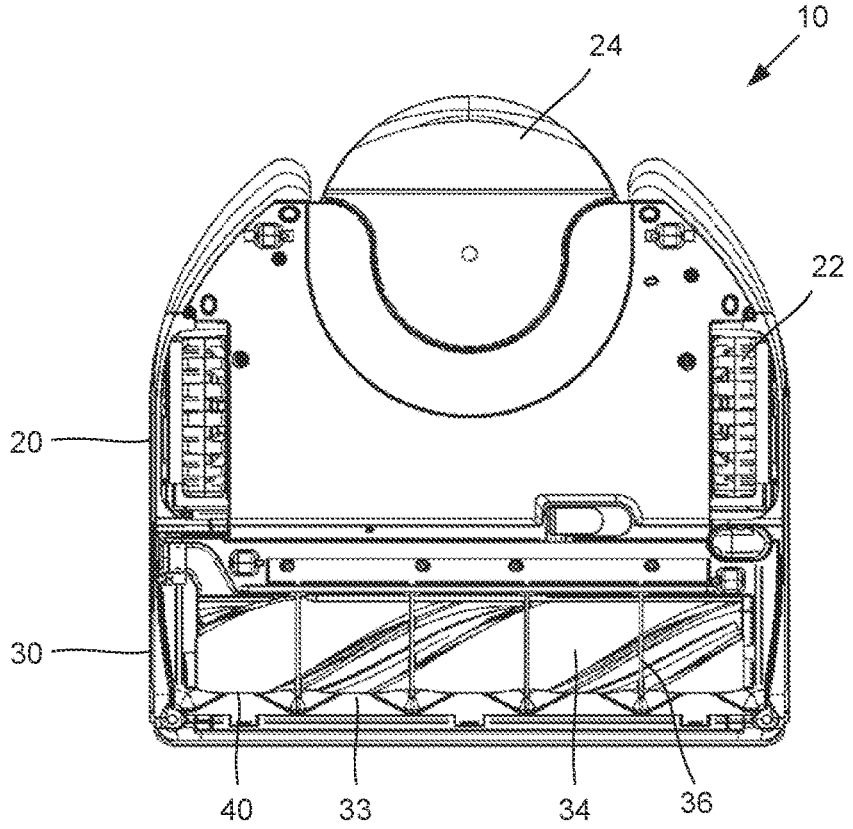
FIG. 1 is a plan view of an underside of a vacuum cleaner.
Figure 2:
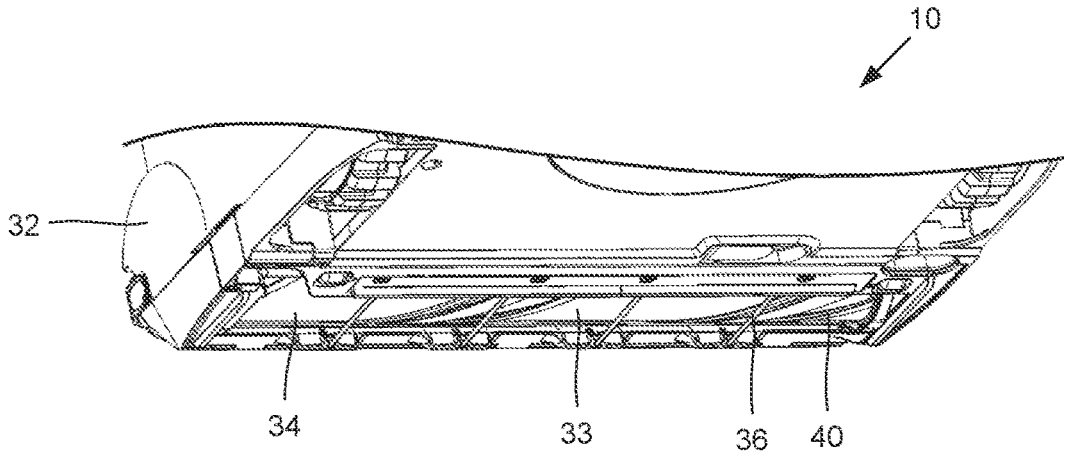
FIG. 2 is a perspective view of a portion of the vacuum cleaner.
Figure 3:
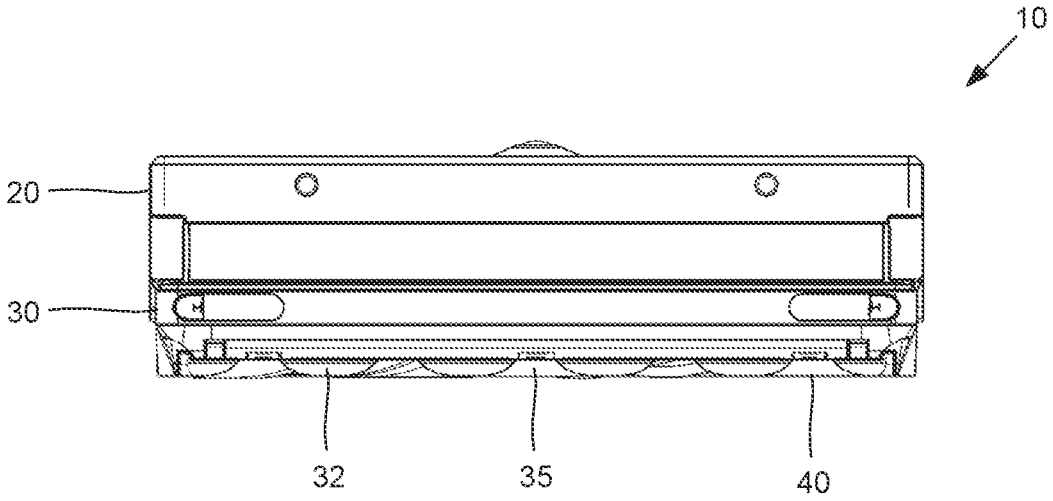
FIG. 3 is a front view of the vacuum cleaner.

The autonomous vacuum cleaner 10 of FIGS. 1 to 3 comprises a main body 20 and a cleaner head 30.

The main body 20 comprises a battery pack, a drivetrain, a navigation system, a vacuum motor, and a dirt separator. Of these, only the wheels 22 of the drivetrain and the underside of the dirt separator 24 are visible in the Figures. The battery pack provides electrical power to the various electrical components of the vacuum cleaner, such as the drivetrain, the navigation system, the vacuum motor, and the drive assembly of the cleaner head. The drivetrain, under the control of the navigation system, manoeuvres the vacuum cleaner within a room or the like. The navigation system is responsible for guiding the vacuum cleaner within the room. The navigation system may comprise sensors for sensing the surrounding environment, which the navigation system then uses to locate the vacuum cleaner within the room and to determine a suitable cleaning path along which the vacuum cleaner is moved. The vacuum motor causes air to be drawn into the cleaner head and carried to the dirt separator, e.g. via ducting within the main body. Dirt entrained in the air is then separated by the dirt separator and the cleansed air is exhausted from the vacuum cleaner.

The cleaner head 30 comprises a housing 32, a brushbar 40, and a drive assembly (not shown) for driving the brushbar 40.

The housing 32 comprises a suction chamber 33 within which the brushbar 40 is rotatably mounted. A suction opening 34 is provided on an underside of the housing 32, and a plurality of debris slots 35 are provided in a front of housing 32. Although not shown, the cleaner head comprises an outlet in fluid communication with the vacuum motor, through which air is drawn from the suction chamber 33 to the dirt separator 24. The cleaner head 30 further comprises a plurality of bars 36, sometimes referred to as rug strips, that extend across the suction opening 34.

In this particular example, the drive assembly is located inside the brushbar 40 and comprises an electric motor and a transmission for transmitting torque generated by the electric motor to the brushbar 40. The electric motor is then powered by the battery pack within the main body. In an alternative example, the drive assembly may be located outside of the brushbar 40. Moreover, rather than an electric motor, the drive assembly could conceivably comprise alternative means, such as an air turbine, for generating the torque necessary to drive the brushbar 40.

Figure 4:
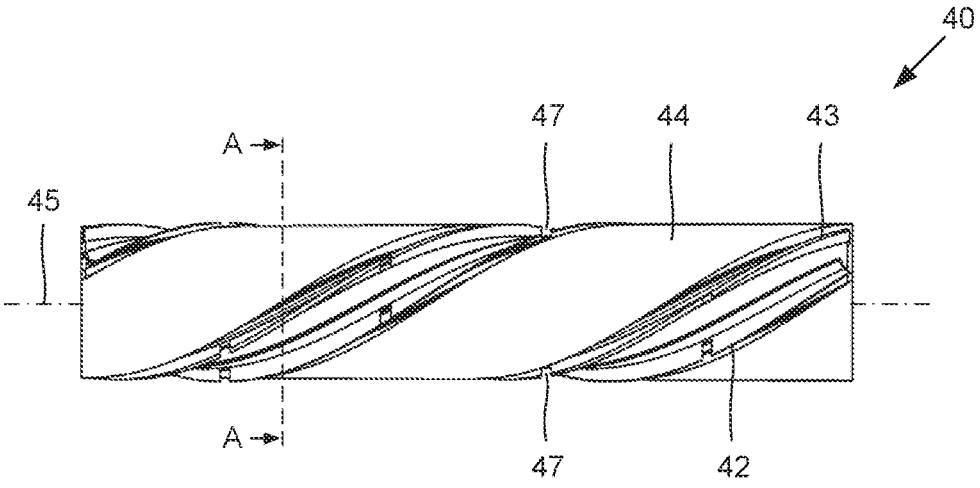
FIG. 4 is a front view of a brushbar forming part of the vacuum cleaner.
Figure 5:
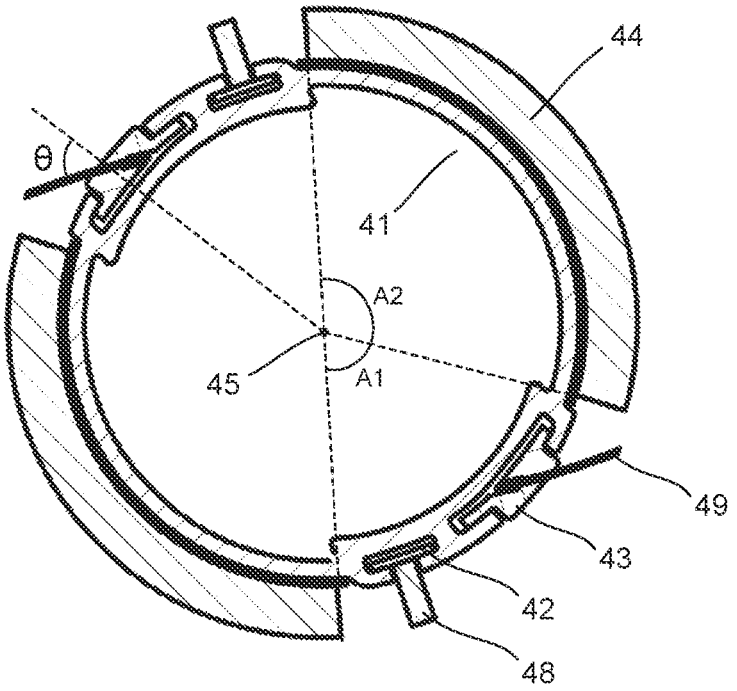
FIG. 5 is a section through the brushbar along the line A-A of FIG. 4.

Referring now to FIGS. 4 and 5, the brushbar 40 comprises a cylindrical body 41, a plurality of bristle strips 42,43, and a plurality of plush strips 44. The bristles strips 42,43 and the plush strips 44 are each arranged helically about the body 41. The term "plush" as used herein refers to a fabric with an even pile that is longer and less dense than that of velvet. By way of example, the pile of plush fabrics is no less than 0.3 cm high whilst the pile of velvet fabrics is less than 0.3 cm.

The bristles strips 42,43 are grouped into pairs. In this particular example, there are four bristle strips 42,43 grouped into two pairs. Each pair of bristle strips comprises a first strip 42 of first bristles 48 and a second strip 43 of second bristles 49. The first strip 42 and the second strip 43 are intended to agitate dirt from different surface types. The first bristles 48 are stiffer and shorter than the second bristles 49, and are intended to agitate dirt from carpeted surfaces. The second bristles 49, being longer and more flexible, are intended to agitate or sweep dirt from hard surfaces, such as wooden or tiled surfaces.

The first bristles 48 and the second bristles 49 may be formed of different materials. As a result, the characteristics of the bristles may be better targeted at the different surface types. In one example, the first bristles 48 are formed of a plastic material, such as polyamide, and the second bristles 49 are formed of carbon fibre or a carbon composite material. The first bristles 48, being formed of a plastic material, are then relatively robust and non-brittle and are well-suited to agitating carpeted surfaces. The second bristles 49, bring formed of a carbon fibre or carbon composite material, are less likely to charge hard surfaces with static electricity. As a result, dirt may be more easily lifted from the hard surfaces.

Figure 6:
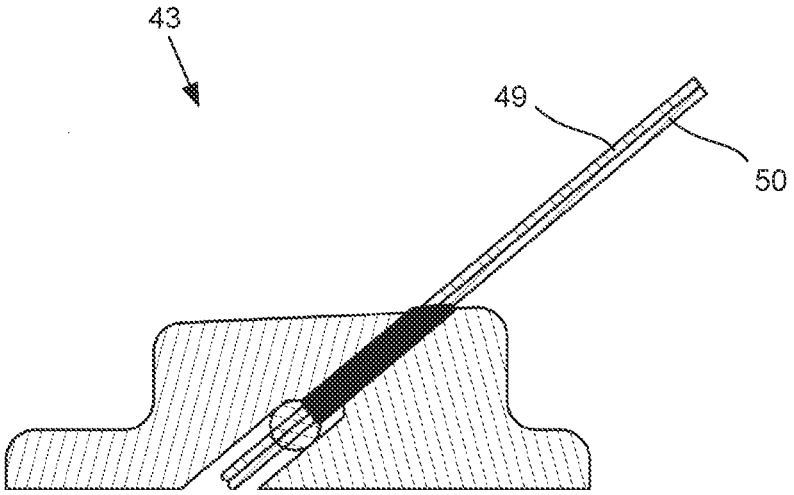
FIG. 6 is a section through a second bristle strip forming part of the brushbar of FIG. 5.

Each of the bristle strips 42,43 may comprise a mixture or blend of different bristles. By way of example, the second strip 43 may comprise third bristles 50 in addition to the second bristles 49. The third bristles 50 may be stiffer than the second bristles 49, and may be located adjacent to the second bristles 49 so as to support the second bristles 49. In the particular example shown in FIG. 6, the third bristles 50 abut against the second bristles 49 and are located behind or rearwardly of the second bristles 49 relative to a direction of rotation of the brushbar 40. This then has the benefit that relatively long and fine bristles may be used for the second bristles 49 to provide a gentle sweeping action across hard surfaces. Without the support provided by the third bristles 50, the direction and movement of the second bristles 49 may be poorly controlled, resulting in poor dirt pickup. In one example, the second bristles 49 may be formed of carbon fibre or a carbon composite material, and the third bristles 50 may be formed of a plastic material, such as polyamide.

The second strip 43 trails the first strip 42. Additionally, the bristles of the second strip 43 are canted rearwards in a direction away from the first strip 42. Canting should be understood to mean that, in a plane normal to the central longitudinal axis 45 of the brushbar 40, the bristles of the second strip 43 are angled relative to a radial line passing through the base of the bristles. Canting the bristles of the second strip 43 has at least two advantages. First, longer bristles may be employed. By employing longer bristles, the required flexibility in the bristles may be achieved using thicker bristles, thereby improving the robustness and reliability of the bristles. Second, by canting the bristles rearward, the bristles perform a sweeping action on contact with the cleaning surface. As a result, the load on the brushbar 40 is reduced, and thus the power drawn by the brushbar 40 (i.e. the electrical power drawn by the drive assembly to drive the brushbar 40 at a given torque and/or speed) is reduced. In the particular example shown in FIG. 5, the bristles of the second strip 43 are canted at an angle, θ, of about 50 degrees relative to the radial line. However, a relatively good balance between pickup performance and power draw may be achieved with a cant angle of between 40 and 60 degrees.

Each of the bristles strips 42,43 is castellated, i.e. has notches. The castellations 47 or notches in the bristles of the first strip 42 are aligned with those in the second strip 43. More particularly, the castellations 47 in the bristles are aligned in planes normal to the central longitudinal axis 45 of the brushbar 40. As noted above, the cleaner head 30 comprises bars 36 that extend across the suction opening 34. The bars 36 prevent rugs, carpet, or the like being lifted up into the suction chamber 33 of the cleaner head 30. When the brushbar 40 is mounted within the suction chamber 33, the bristle strips 42,43 project downward beyond the bars 36 such they can agitate dirt from the cleaning surface. The castellations 47 in the bristle strips 42,43 are aligned with the bars 36 such that, as the brushbar 40 rotates, the castellations 47 pass over the bars 36. If the bristle strips 42,43 were continuous rather than castellated, the bristles would beat against the bars 36 as the brushbar 40 rotates, consuming power and generating noise. By providing castellations 47 in the bristle strips 42,43 that are aligned with the bars 36, the power drawn by the brushbar 40 is reduced. Additionally, the level of the noise generated by the brushbar 40 is reduced and/or the quality is improved.

The plush strips 44 are arranged on either side of each pair of bristle strips 42,43. In contrast to the bristle strips 42,43, which are relatively narrow, each of the plush strips 44 is relatively wide. Each of the plush strips 44 comprises a plush of fibres. The fibres have a relatively low stiffness and a relatively high density (e.g. 2000-3000 fibres per $mm^2$), which gives the fibres a soft or plush feel. The fibres have a lower stiffness than the first bristles 48, and a shorter length than the second bristles 49. In this particular example, the fibres are formed of the same material as the first bristles 48 (e.g. polyamide) and have the same length of the first bristles 48. However, the fibres have a significantly smaller diameter, thereby giving the fibres a much lower stiffness.

The plush strips 44 cover the majority of the body 41, the benefits of which are described below. In order to maximise the area of the body 41 covered by the plush strips 44, the bristles strips 42,43 are positioned as close as possible to one another. Each of the bristles strips 42,43 comprises a base to which the bristles are secured (e.g. by overmoulding the base onto the bristles). The base of each bristle strip 42,43 is then seated within a slot or track in the body 41 of the brushbar 40. The proximity of the bristle strips 42,43 of each pair is then constrained or limited by the minimal permissible wall thickness between the two slots in the body 41. The second strip 43 trails the first strip 42. By having the longer, more flexible bristles of the second strip 43 trail the shorter, stiffer bristles of the first strip 42, the two bristle strips 42,43 may be brought closer together whilst ensuring that the leading bristles, upon flexing rearwards during use, do not interfere with or get caught up in the trailing bristles. By bringing the bristle strips 42,43 closer together in this way, the available area for the plush strips 44 is increased.

Each pair of bristle strips 42,43 may be said to subtend a first central angle, A1, in a plane normal to the central longitudinal axis of the brushbar, and each plush strip may be said to subtend a second central angle, A2. By arranging the bristle strips 42,43 in the manner described above, it is possible to achieve a second central angle, A2, that is greater than the first central angle, A1. As a result, the majority of the body 41 of the brushbar 40 is covered with plush fibres, the benefits of which are described below.

In spite of the desire to maximise the area covered by the plush strips 44, a minimal circumferential spacing is nevertheless maintained between the bristle strips 42,43 and the plush strips 44. In particular, a first circumferential spacing is provided between the first strip 42 and the adjacent plush strip 44, which is no smaller than the length of the fibres. This then has the advantage that, when the fibres of the plush strip 44 flex or deform rearwards on contacting the cleaning surface, the fibres do not interfere with or get caught up in the bristles of the first strip 42. Similarly, a second circumferential spacing is provided between the second strip 43 and the adjacent plush strip 44, which is no smaller than the length of the second bristles. Again, this then has the advantage that, when the bristles of the second strip 43 flex or deform rearwards on contacting the cleaning surface, the bristles do not interfere with or get caught up in the fibres of the plush strip 44.

During use of the cleaner head 30, the brushbar 40 rotates to agitate dirt from the cleaning surface. As noted, the first bristle strips 42 and the second bristle strips 43 are intended to agitate dirt from different types of surface. More particularly, the first strips 42 are intended to agitate dirt from carpeted surfaces, and the second strips 43 are intended to agitate dirt from hard surfaces. The brushbar 40 is mounted within the suction chamber 33 such that, when the cleaner head 30 is on a hard surface, the bristles of the first strip 42 are spaced from and do not contact the surface. Dirt is then agitated from the surface by the bristles of the second strip 43. Although not readily apparent from FIG. 5, the radial extent or outer diameter of the bristles of the second strip 43 is slightly greater than that of the first strip 42. Moreover, as the brushbar 40 rotates, the bristles of the second strip 43 straighten slightly due to centrifugal forces, i.e. the cant angle, θ, decreases. As a result, the radial extent or outer diameter of the bristles of the second strip 43 increases. In the present example, the fibres of the plush strips 44 are also spaced from hard surfaces. In an alternative example, the length of the fibres of the plush strips 44 may be longer such that the fibres contact hard surfaces to provide a buffing or polishing effect.

As noted above, the second bristle strip 43 trails the first 42. This then has the advantage that the two bristle strips 42,43 of each pair may be brought closer together, thereby increasing the available area for the plush strips 44. A further advantage of this arrangement is that the first bristles 48, being stiffer and potentially less brittle than the second bristles 49, may protect the second bristles 49 from the impact of large debris, which might otherwise damage the second bristles 49.

The suction generated by the vacuum motor creates a negative pressure within the suction chamber 33. As a result, air is drawn into the suction chamber 33 from outside the cleaner head 30 via the suction opening 34. Dirt agitated by the brushbar 40 is then entrained by this moving air. The cleaner head 30 also comprises debris slots 35 provided in a front of housing 32. Each slot 35 provides a path through which large debris may pass into the suction chamber 33. Without the debris slots 35, the cleaner head 30 may push or snowplough large debris around the cleaning surface. However, in addition to large debris, each slot 35 provides a path through which air may be drawn into the suction chamber 33. In the absence of the plush strips 44, air would be drawn in through the debris slots 35, around the top of the brushbar 40, and out through the outlet of the cleaner head 30. The pressure within the suction chamber 33 would then increase, i.e. there would be a loss of negative pressure within the suction chamber 33. As a consequence of the loss in negative pressure, the flow rate of the air drawn in through the suction opening 34 would decrease. Less dirt would then be entrained by the air and thus the pickup performance of the cleaner head 30 would worsen.

The plush strips 44 create a restriction between the brushbar 40 and the surrounding housing 32. This restriction significantly reduces the flow of air over the top of the brushbar 40. As a result, a good negative pressure is maintained within the suction chamber 33, which in turn provides a good pickup performance. Large debris is then drawn into the debris slots 35, not so much by air moving through the slots 35, but by the forward movement of the cleaner head 30. The cleaner head 30 is therefore capable of picking up large debris via the slots 35 at the front of the housing 32 whilst also ensuring good pickup of fine dirt from beneath the housing 32.

Cleaner heads having large debris slots are known. However, such cleaner heads typically include an actuator, such as a switch or slider, to selectively open and close the slots. A user then opens the slots momentarily upon identifying large debris, and close the slots shortly thereafter once the large debris has been picked up. With an autonomous vacuum cleaner, such control is not straightforward. However, with the brushbar 40 and the cleaner head 30 described herein, the debris slots 35 may be left permanently open. The plush strips 44 then ensure that, in spite of the permanently open slots, a good head pressure, and thus good dirt pickup, is maintained.

In the example described above, the brushbar 40 comprises two pairs of bristle strips 42,43. Conceivably, the brushbar 40 may comprise a single pair of bristle strips, thereby increasing the available area of the body 41 that may be covered by plush fibres. There are, however, benefits in having two pairs of bristle strips. By having two pairs of bristle strips, the bristle strips 42,43 contact the cleaning surface twice during each rotation of the brushbar 40. Consequently, in comparison to a single pair of bristle strips which contacts the cleaning surface only once, the same degree of agitation may be achieved (i.e. the same power may be driven into the cleaning surface) using less dense or more flexible bristles. This in turn may reduce the noise generated by the brushbar 40. As noted, by employing two pairs of bristles 42,43, the available area of the body 41 that may be covered by the plush fibres is reduced and thus there may be a loss of pressure within the suction chamber 33, in comparison to a single pair of bristle strips. However, this potential loss in pressure may be recovered by increasing the speed of the brushbar 40. For a brushbar 40 having two pairs of bristle strips 42,43, a good balance between pickup performance and noise may be observed at speeds of between 2500 rpm and 3500 rpm.

Conceivably, the bristle strips 42,43, rather than being grouped into pairs, could be arranged evenly about the body 41. However, by grouping the bristle strips 42,43 into pairs, the number of plush strips 44 is halved, thereby simplifying the manufacture and assembly of the brushbar 40. Additionally, the total surface area of the plush strips 44 can be increased, which in turn provides a greater restriction and thus improved head pressure. There may also be acoustic benefits in grouping the bristle strips 42,43 into pairs. For example, if the brushbar 40 were to comprise four bristle strips spaced evenly about the body 41, the bristle strips would impact the cleaning surface four times with each rotation of the brushbar 40. By grouping the bristles strips 42,43 into pairs, each pair of bristle strips 42,43 may be regarded as generating a single impact. Accordingly, the bristle strips 42,43 impact the cleaning surface twice with each rotation. By halving the number of impacts with each rotation, the level of noise may be reduced and/or the quality may be improved.

Each of the bristle strips 42,43 spans 360 degrees about the body 41. Conceivably, the bristle strips 42,43 may span a different angle, in particular a smaller angle. However, by spanning at least 360 degrees, each bristle strip 42,43 is in constant contact with the cleaning surface. This may then have benefits in terms of noise and power draw during rotation of the brushbar 40. By contrast, if the bristle strips 42,43 spanned a smaller angle then the level and/or quality of the noise may worsen and/or the power drawn by the brushbar 40 may vary as different bristle strips come into contact and then leave the cleaning surface.

Whilst the vacuum cleaner described above is autonomous, the brushbar 40 and/or the cleaner head 30 may be used with other types of vacuum cleaner, such as upright, canister or stick vacuum cleaners. In particular, the brushbar 40 may provide increased head pressure in cleaner heads having debris slots. Moreover, the brushbar 40 makes possible the use of debris slots that are permanently open, thus avoiding the need to manually open and close the debris slots.

The invention claimed is:

1. A brushbar for a vacuum cleaner comprising:

a cylindrical body;

one or more pairs of bristle strips arranged helically about the body, each of the one or more pairs of bristle strips comprising a first strip of first bristles and a second strip of second bristles, the first bristles being stiffer and shorter than the second bristles; and one or more plush strips arranged helically about the body, the plush strips being arranged on either side of the one or more pairs of bristle strips and comprising a plush of fibres, wherein, in a plane normal to a central longitudinal axis of the brushbar, the one or more pairs of bristle strips subtends a first central angle, the one or more plush strips subtends a second central angle, and the second central angle is greater than the first central angle.

2. The brushbar as claimed in claim 1, wherein the first and second bristles are formed of different materials.

3. The brushbar as claimed in claim 2, wherein the first bristles are formed of a plastic material, and the second bristles are formed of carbon fibre or a carbon composite material.

4. The brushbar as claimed in claim 1, wherein the second strip comprises third bristles located adjacent to the second bristles, and the third bristles are stiffer than the second bristles.

5. The brushbar as claimed in claim 4, wherein the second bristles are formed of carbon fibre or a carbon composite material, and the third bristles are formed of a plastic material.

6. The brushbar as claimed in claim 1, wherein the bristles of the second strip are canted in a direction away from the first strip.

7. The brushbar as claimed in claim 6, wherein the bristles of the second strip are canted at an angle of between 40 and 60 degrees.

8. The brushbar as claimed in claim 1, wherein the fibres have a lower stiffness than the first bristles, and a shorter length than the second bristles.

9. The brushbar as claimed in claim 1, wherein the brushbar comprises a first circumferential spacing between each first strip and an adjacent plush strip, and the first circumferential spacing is no smaller than the length of the fibres.

10. The brushbar as claimed in claim 1, wherein the brushbar comprises a second circumferential spacing between each second strip and an adjacent plush strip, and the second circumferential spacing is no smaller than the length of the second bristles.

11. The brushbar as claimed in claim 1, wherein each of the one or more pairs of bristle strips comprises castellations in the bristles.

12. The brushbar as claimed in claim 11, wherein castellations in the bristles of the first strip and castellations in the bristles of the second strip are aligned in planes normal to a central longitudinal axis of the brushbar.

13. The brushbar as claimed in claim 1, wherein the brushbar comprises two pairs of bristle strips.

14. The brushbar as claimed in claim 1, wherein each of the one or more pairs of bristle strips spans at least 360 degrees about the body.

15. A cleaner head for a vacuum cleaner comprising:

a housing having a suction chamber;

the brushbar as claimed in claim 1, the brushbar being rotatably mounted within the suction chamber; and a suction opening formed on an underside of the housing through which the brushbar is able to agitate a surface.

16. The cleaner head as claimed in claim 15, wherein the cleaner head comprises one or more debris slots formed in a front of the housing through which debris may pass to the suction chamber.

17. The cleaner head as claimed in claim 15, wherein the cleaner head comprises one or more bars that extend across the suction opening, the bristle strips project downward beyond the bars, and the bristle strips comprise castellations in the bristles that are aligned with the bars.

18. The cleaner head as claimed in claim 15, wherein the second strip trails the first strip in a direction of rotation of the brushbar.

19. The cleaner head as claimed in claim 15, wherein the cleaner head comprises a drive assembly for driving the brushbar, the brushbar comprises two pairs of bristle strips, and the drive assembly drives the brushbar at an unloaded speed of between 2500 rpm and 3500 rpm.

20. A vacuum cleaner comprising the brushbar as claimed in claim 1.

21. The vacuum cleaner as claimed in claim 20, wherein the vacuum cleaner is an autonomous vacuum cleaner.

* * * * *